US012708168B2

(12) United States Patent
Kefauver et al.

(10) Patent No.: US 12,708,168 B2
(45) **Date of Patent: *Aug. 18, 2026**

(54) HEAD PROTECTION WITH INTEGRATED AIR FILTRATION

(71) Applicant: GILZ LLC, Albuquerque, NM (US)

(72) Inventors: Michael Joshua Kefauver, Albuquerque, NM (US); Brandon Lance Johnson, Albuquerque, NM (US)

(73) Assignee: GILZ LLC, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/000,238

(22) Filed: Dec. 23, 2024

(65) Prior Publication Data

US 2025/0127253 A1 Apr. 24, 2025

Related U.S. Application Data

(63) Continuation of application No. 18/031,577, filed as application No. PCT/US2021/054329 on Oct. 9, 2021, now Pat. No. 12,213,553.

(Continued)

(51) Int. Cl.
*A42B 3/28* (2006.01)

(52) U.S. Cl.
CPC ..... *A42B 3/286* (2013.01); *A42B 3/288* (2013.01)

(58) Field of Classification Search
CPC ..... A42B 3/286; A42B 3/288; A42B 3/24; A62B 18/006; A62B 18/04
See application file for complete search history.

(56) References Cited

U.S. PATENT DOCUMENTS 3,362,403 A 1/1968 Fleming et al.
4,549,541 A 10/1985 Sundahl
(Continued)

FOREIGN PATENT DOCUMENTS

CN 2277195 Y 4/1998
CN 2313417 Y 4/1999
(Continued)

OTHER PUBLICATIONS

PCT/US2021/054329, International Search Report & Written Opinion (Jan. 25, 2022).
U.S. Appl. No. 18/031,577, filed Apr. 12, 2023.

*Primary Examiner* — Khaled Annis
(74) *Attorney, Agent, or Firm* — LOZA & LOZA, LLP; Kevin L. Soules

(57) ABSTRACT

A system of head protection with an integrated air filtration mechanism for protecting the user from impact/concussion and ambient air pollution. Example embodiments comprise a rigid helmet shell covering the head of the user and a fabric air barrier around the user's neck, a battery powered filtered centrifugal fan contained inside an external detachable cowl apparatus adjoins to a helmet external top spoiler with a mounting system that is easily removable to meet impact attenuation standards The cowl apparatus directs clean filtered air into the duct system—a top spoiler funnel connected to an internal clean air duct and exits the visor air curtain providing continual clean laminar airflow between the user's face and the face shield. One or more sensors, calibrated to detect harmful particulates and a processor to automatically activate the system as a protective measure when harmful particulates are encountered and a sensor to detect when filter element needs replacement.

20 Claims, 3 Drawing Sheets

Related U.S. Application Data

(60) Provisional application No. 63/090,781, filed on Oct. 13, 2020.

(56) References Cited

U.S. PATENT DOCUMENTS

| | | | |
|---|---|---|---|
| 4,619,255 | A | 10/1986 | Spinosa et al. |
| 4,886,056 | A | 12/1989 | Simpson |
| 5,029,342 | A | 7/1991 | Stein |
| 5,125,402 | A | 6/1992 | Greenough |
| 5,245,994 | A | 9/1993 | Chang et al. |
| 5,277,653 | A | 1/1994 | Gadgil |
| 5,318,018 | A | 6/1994 | Puma |
| D348,751 | S | 7/1994 | Bosack |
| 5,758,639 | A | 6/1998 | Ikonen |
| 5,794,260 | A | 8/1998 | Schegerin |
| 5,796,341 | A | 8/1998 | Stratiotis |
| 6,081,929 | A | 7/2000 | Rothrock |
| 7,080,414 | B1 | 7/2006 | Montero et al. |
| 7,792,615 | B2 | 9/2010 | Aimar |
| 8,316,850 | B2 | 11/2012 | Grilliot et al. |
| 8,371,830 | B2 | 2/2013 | Winkler et al. |
| 9,629,411 | B2 | 4/2017 | Dick |
| 9,833,645 | B2 | 12/2017 | Jones |
| 10,064,559 | B2 | 9/2018 | Tzvieli et al. |
| 10,080,861 | B2 | 9/2018 | Tzvieli et al. |
| 10,130,299 | B2 | 11/2018 | Tzvieli et al. |
| 10,130,308 | B2 | 11/2018 | Tzvieli et al. |
| 10,136,856 | B2 | 11/2018 | Tzvieli et al. |
| 10,137,320 | B2 * | 11/2018 | Walker ..... A62B 18/084 |
| 10,201,207 | B2 | 2/2019 | Vanderwoude |
| 10,391,337 | B2 | 8/2019 | Curran |
| 10,524,696 | B2 | 1/2020 | Tzvieli et al. |
| 10,653,197 | B2 | 5/2020 | Perusse et al. |
| 10,690,763 | B2 | 6/2020 | Shouldice et al. |
| 10,709,194 | B2 | 7/2020 | Johnstone |
| 10,765,380 | B2 | 9/2020 | Everman et al. |
| 10,850,050 | B2 | 12/2020 | Alizoti et al. |
| 11,019,872 | B2 | 6/2021 | Calilung |
| D927,081 | S | 8/2021 | Fukuyama |
| 11,131,310 | B1 | 9/2021 | Emery |
| D934,505 | S | 10/2021 | Hunt et al. |
| 11,382,380 | B2 | 7/2022 | Dutour |
| 11,413,479 | B2 | 8/2022 | Kilmer |
| 11,497,867 | B2 | 11/2022 | Costella et al. |
| 11,517,066 | B2 | 12/2022 | Krishnan |
| 11,812,816 | B2 | 11/2023 | Gardner |
| 12,213,553 | B2 * | 2/2025 | Kefauver ..... A62B 18/006 |
| 2001/0032348 | A1 | 10/2001 | Diaz |
| 2001/0037519 | A1 | 11/2001 | Paris |
| 2002/0056458 | A1 | 5/2002 | Evonitz |
| 2002/0073994 | A1 | 6/2002 | Patel |
| 2002/0134381 | A1 | 9/2002 | Bonhomme |
| 2003/0000001 | A1 | 1/2003 | Mcdonald et al. |
| 2003/0182711 | A1 | 10/2003 | Klotz |
| 2004/0008157 | A1 | 1/2004 | Brubaker |
| 2005/0036100 | A1 | 2/2005 | Rice |
| 2005/0060788 | A1 | 3/2005 | Green |
| 2005/0109337 | A1 | 5/2005 | Diaz et al. |
| 2007/0101995 | A1 | 5/2007 | Chornyj |
| 2007/0113318 | A1 | 5/2007 | Weston |
| 2008/0302360 | A1 | 12/2008 | Chambers |
| 2009/0266361 | A1 | 10/2009 | Bilger |
| 2010/0026516 | A1 | 2/2010 | Lazar et al. |
| 2010/0107292 | A1 | 5/2010 | Chevallier et al. |
| 2010/0108067 | A1 | 5/2010 | Walker |
| 2011/0004841 | A1 | 1/2011 | Gildred et al. |
| 2011/0056496 | A1 | 3/2011 | Tilley et al. |
| 2011/0231977 | A1 | 9/2011 | Rupnick |
| 2012/0052469 | A1 | 3/2012 | Sobel et al. |
| 2012/0164007 | A1 | 6/2012 | Gamble et al. |
| 2013/0009216 | A1 | 1/2013 | Tsai et al. |
| 2013/0014752 | A1 | 1/2013 | Ausen |
| 2013/0152920 | A1 | 6/2013 | Billingsley |
| 2015/0181972 | A1 | 7/2015 | Djerassi |
| 2015/0320960 | A1 | 11/2015 | Barlow |
| 2015/0359680 | A1 | 12/2015 | Gardner |
| 2016/0073722 | A1 | 3/2016 | Eustace |
| 2016/0355262 | A1 | 12/2016 | Sharma |
| 2017/0022807 | A1 | 1/2017 | Dursun et al. |
| 2017/0136268 | A1 | 5/2017 | Boffey |
| 2017/0259089 | A1 | 9/2017 | De Jesus |
| 2017/0368381 | A1 | 12/2017 | Awiszus et al. |
| 2018/0014597 | A1 | 1/2018 | Cooke |
| 2018/0092588 | A1 | 4/2018 | Tzvieli et al. |
| 2018/0103711 | A1 | 4/2018 | Abrahamson |
| 2018/0256115 | A1 | 9/2018 | Campbell et al. |
| 2019/0167211 | A1 | 6/2019 | Everman et al. |
| 2019/0175411 | A1 | 6/2019 | Awiszus |
| 2019/0175961 | A1 | 6/2019 | Awiszus |
| 2019/0231005 | A1 | 8/2019 | Jefferis et al. |
| 2020/0206544 | A1 | 7/2020 | Vaughan |
| 2020/0261009 | A1 | 8/2020 | Everman et al. |
| 2021/0034145 | A1 | 2/2021 | Armstrong et al. |
| 2021/0098678 | A1 | 4/2021 | Palaniswamy |
| 2021/0260415 | A1 | 8/2021 | Darling et al. |
| 2021/0283432 | A1 | 9/2021 | Mou et al. |
| 2021/0289851 | A1 | 9/2021 | Hall et al. |
| 2021/0289875 | A1 | 9/2021 | Hall et al. |
| 2021/0290989 | A1 | 9/2021 | Hall et al. |
| 2021/0299371 | A1 | 9/2021 | Lange |
| 2021/0308496 | A1 | 10/2021 | Monteleone |
| 2021/0330831 | A1 | 10/2021 | Laty |
| 2022/0016450 | A1 | 1/2022 | Hall |
| 2022/0016451 | A1 | 1/2022 | Hall |
| 2022/0087356 | A1 | 3/2022 | Asnis |
| 2022/0184427 | A1 | 6/2022 | Kota |
| 2022/0295923 | A1 | 9/2022 | Hall |
| 2022/0305302 | A1 | 9/2022 | Hall |
| 2023/0355915 | A1 | 11/2023 | Adametz |
| 2023/0389642 | A1 | 12/2023 | Kefauver |
| 2023/0414975 | A1 | 12/2023 | Krepel |
| 2024/0058629 | A1 | 2/2024 | Anvari |

FOREIGN PATENT DOCUMENTS

| | | | |
|---|---|---|---|
| CN | 2329205 | Y | 7/1999 |
| CN | 2577618 | Y | 10/2003 |
| CN | 2627865 | Y | 7/2004 |
| CN | 2875496 | Y | 3/2007 |
| CN | 201283955 | Y | 8/2009 |
| CN | 102716556 | A | 10/2012 |
| CN | 103070510 | A | 5/2013 |
| CN | 103458781 | A | 12/2013 |
| CN | 103949017 | A | 7/2014 |
| CN | 203775388 | U | 8/2014 |
| CN | 203852758 | U | 10/2014 |
| CN | 203852759 | U | 10/2014 |
| CN | 203852760 | U | 10/2014 |
| CN | 203898976 | U | 10/2014 |
| CN | 204709670 | U | 10/2015 |
| CN | 205106452 | U | 3/2016 |
| CN | 205161965 | U | 4/2016 |
| CN | 205337702 | U | 6/2016 |
| CN | 205491022 | U | 8/2016 |
| CN | 205494724 | U | 8/2016 |
| CN | 205597237 | U | 9/2016 |
| CN | 103961822 | B | 4/2017 |
| CN | 107361428 | A | 11/2017 |
| CN | 207012428 | U | 2/2018 |
| CN | 108452450 | A | 8/2018 |
| CN | 207855113 | U | 9/2018 |
| CN | 208260027 | U | 12/2018 |
| CN | 208389216 | U | 1/2019 |
| CN | 109937000 | A | 6/2019 |
| CN | 110461284 | A | 11/2019 |
| CN | 210078651 | U | 2/2020 |
| CN | 111135493 | A | 5/2020 |
| CN | 111165965 | A | 5/2020 |
| CN | 111202920 | A | 5/2020 |
| CN | 111296983 | A | 6/2020 |
| CN | 111346315 | A | 6/2020 |
| CN | 211021142 | U | 7/2020 |
| CN | 211050626 | U | 7/2020 |
| CN | 111659043 | A | 9/2020 |

(56) References Cited

FOREIGN PATENT DOCUMENTS

| | | | |
|---|---|---|---|
| CN | 111659044 | A | 9/2020 |
| CN | 211486100 | U | 9/2020 |
| CN | 211703590 | U | 10/2020 |
| CN | 211935233 | U | 11/2020 |
| CN | 211984039 | U | 11/2020 |
| CN | 112121320 | A | 12/2020 |
| CN | 212306969 | U | 1/2021 |
| CN | 212308685 | U | 1/2021 |
| CN | 212466876 | U | 2/2021 |
| CN | 212697866 | U | 3/2021 |
| CN | 212756877 | U | 3/2021 |
| CN | 212814395 | U | 3/2021 |
| CN | 213029923 | U | 4/2021 |
| CN | 213154302 | U | 5/2021 |
| CN | 213253454 | U | 5/2021 |
| CN | 114304799 | A | 4/2022 |
| DE | 4222822 | A1 | 1/1994 |
| DE | 102015001513 | A1 | 3/2016 |
| DE | 202017107526 | U1 | 2/2018 |
| EP | 2645362 | A1 | 10/2013 |
| EP | 2112381 | A3 | 4/2014 |
| EP | 3399881 | B1 | 11/2021 |
| EP | 3442635 | B1 | 8/2022 |
| ES | 2883624 | T3 | 12/2021 |
| GB | 2498547 | B | 2/2015 |
| GB | 2575815 | B | 12/2020 |
| JP | 2009106690 | A | 5/2009 |
| JP | 2012524596 | A | 10/2012 |
| JP | 2013038989 | A | 2/2013 |
| JP | 2020500639 | A | 1/2020 |
| JP | 3232865 | U | 7/2021 |
| JP | 6940414 | B2 | 9/2021 |
| KR | 101472759 | B1 | 12/2014 |
| KR | 101796969 | B1 | 11/2017 |
| KR | 20190048715 | A | 5/2019 |
| KR | 20200120785 | A | 10/2020 |
| KR | 102211703 | B1 | 2/2021 |
| KR | 102219840 | B1 | 2/2021 |
| RU | 2704803 | C2 | 10/2019 |
| TW | I686147 | B | 3/2020 |
| WO | 9005565 | A1 | 5/1990 |
| WO | 1999062364 | A1 | 12/1999 |
| WO | 2010122560 | A1 | 10/2010 |
| WO | 2011126887 | A2 | 10/2011 |
| WO | 2016079606 | A1 | 5/2016 |
| WO | 2018069790 | A1 | 4/2018 |
| WO | 2018104805 | A1 | 6/2018 |
| WO | 201906329 | A1 | 1/2019 |
| WO | 2019069329 | A1 | 4/2019 |
| WO | 2019200474 | A1 | 10/2019 |

* cited by examiner

HEAD PROTECTION WITH INTEGRATED AIR FILTRATION

CROSS REFERENCE TO RELATED PATENT APPLICATIONS

This patent application is a Continuation of, and claims priority to, U.S. patent application Ser. No. 18/031,577 entitled "HEAD PROTECTION WITH INTEGRATED AIR FILTRATION," which was filed Apr. 12, 2023, and is herein incorporated by reference in its entirety.

U.S. patent application Ser. No. 18/031,577 is a National Stage application under 35 U.S.C. 371, of PCT Application PCT/US2021/054329, entitled "HEAD PROTECTION WITH INTEGRATED AIR FILTRATION," which was filed Oct. 9, 2021, and is herein incorporated by reference in its entirety.

This patent application, U.S. patent application Ser. No. 18/031,577, and PCT Application PCT/US2021/054329 claim the priority and benefit, under 35 U.S.C. § 119(e), of U.S. Provisional Patent Application Ser. No. 63/090,781, entitled "HEAD PROTECTION WITH INTEGRATED AIR FILTRATION", filed Oct. 13, 2020. U.S. Provisional Patent Application Ser. No. 63/090,781 is herein incorporated by reference in its entirety.

TECHNICAL FIELD

The present invention relates to the field of head protection such as helmets, combined with air filtration.

BACKGROUND

Ambient air pollution accounts for an estimated 4.2 million deaths globally per year due to stroke, heart disease, lung cancer and chronic respiratory diseases (WHO 2016). Fine particulate matter (PM) pollution—known as PM2.5 because the particulates are 2.5 microns in diameter or less—has been linked to these deaths due to the ability of these particles to pass directly through the lungs and into the bloodstream. Forty percent of Americans (around 135 million people) are living in places with unhealthy levels of air pollution according to the American Lung Association. Many U.S. cities measured increased levels of year-round particulate pollution largely due to the increase in wildfires. Diesel exhaust is classified by the EPA as a human carcinogen. Motorcyclists have limited options for protection from ambient air pollution and are particularly vulnerable to diesel exhaust, fine road dust, wildfire smoke and urban smog (or soot).

SUMMARY

The present invention provides a new type of head protection with an integrated air filtration mechanism that provides a flow of clean filtered air to the user in heavily particulate contaminated environments. Example embodiments of the present invention provide continuous filtered laminar airflow over the user's face allowing the user to breathe clean filtered air unobstructed by a facemask or respirator. Embodiments comprise a rear detachable cowl that houses and protects system components and integrates with a mount system that can meet current Department of Transportation (DOT) testing procedures FMVSS no. 218 for impact attenuation. Example embodiments comprise a facepiece-embedded air trap baffle with PM particle sensors calibrated to the level of PM 10, PM 2.5 or PM 1.0, for example, that can activate the system after communicating with the microprocessor control board. The microprocessor control board can also be configured to adjust duty cycles (fan speed) based on the PM load, e.g., high speed for high load. The system can also be manually switched on by the user as needed for anti-fogging of the visor or cooling. A battery-powered filtered centrifugal (blower) fan contained inside the detachable cowl can be adjoined to the top spoiler funnel with the mount system. The mount system can adjoin the detachable cowl with the top spoiler funnel for an airtight seal while also detaching from the helmet at specified DOT impact/loading conditions. The top spoiler funnel connects to the internal clean air duct that then connects to the visor air curtain (knife edge) providing continual clean laminar airflow between the user's face and the visor (or face shield). Example embodiments provide a neck dam: a flexible slip that attaches to the base of the helmet and surrounds the neck of the user creating a supplemental protective barrier against outside air contaminants. Example embodiments comprise a modified universal bayonet connector that attaches to the blower fan inlet and can accommodate several off-the-shelf National Institute of Health and Safety (NIOSH)-certified filters resistant to both oil and non-oil particulate contaminants of PM 2.5 or less. The present invention also has industrial and military applications and can provide secondary benefits of anti-fogging of the visor and cooling to the user.

BRIEF DESCRIPTION OF THE DRAWINGS

The accompanying figures, in which like reference numerals refer to identical or functionally similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in the following non-limiting examples can be varied, and are cited merely to illustrate one or more embodiments and are not intended to limit the scope thereof.

Figure 1:
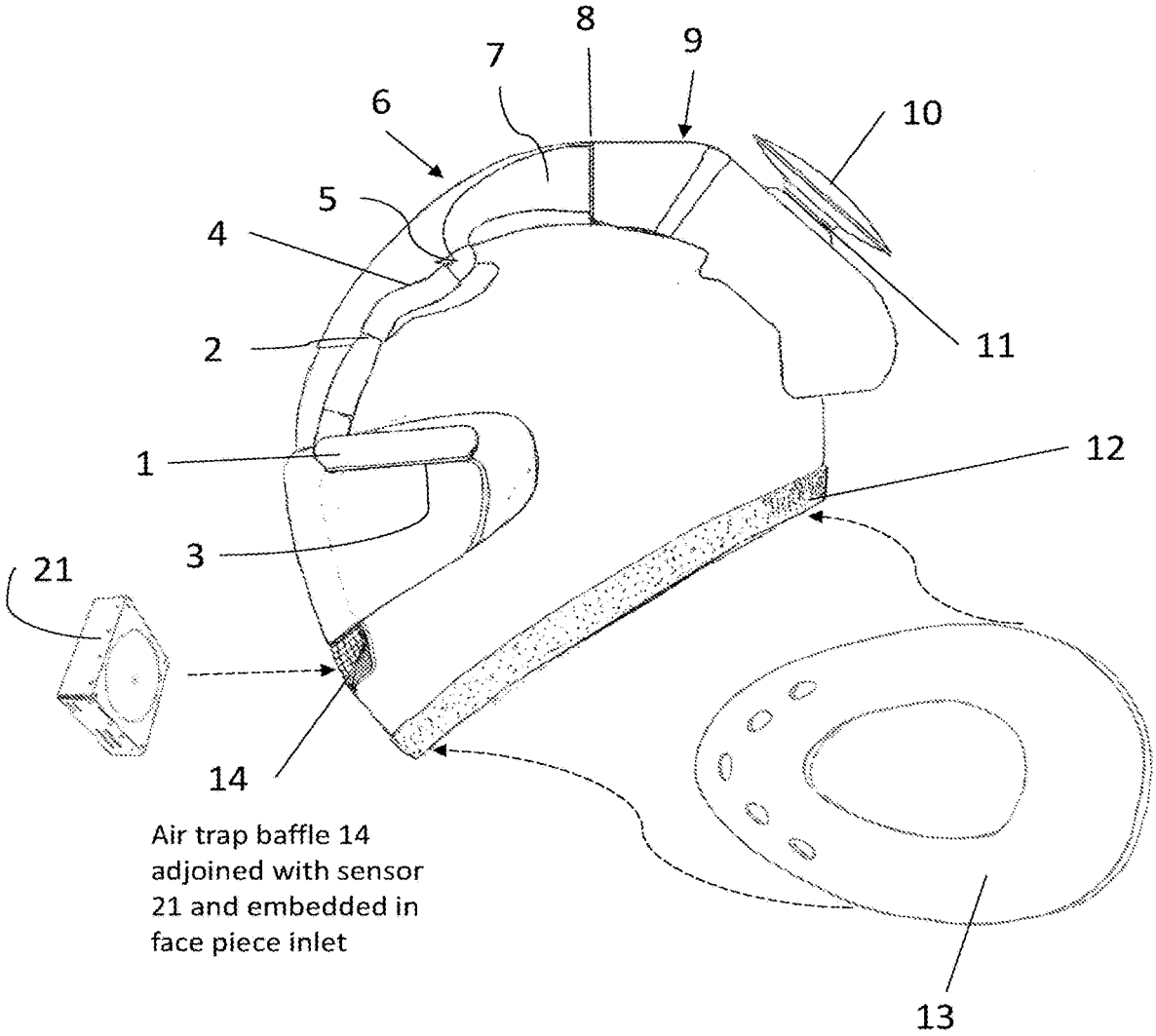
FIG. 1 is a schematic illustration of an example embodiment comprising a whole helmet system, providing a left view with overlay of duct system components and detachable cowl.

FIG. 1 is a schematic illustration of an example embodiment comprising a whole helmet system, providing a left view with overlay of the duct system components and detachable cowl 9. A visor air curtain 1 connected to an internal air duct 4, connected to a top spoiler funnel 7 in the top spoiler 6 that adjoins a detachable cowl 9 comprising the universal bayonet connector 11 and filter element 10. The cowl houses internal components illustrated in FIGS. 2-3. A neck dam (or barrier) 13 attaches to a Velcro adhesive 12 surrounding the base of the helmet body. A micro-particulate matter sensor 21 shown (enlarged view) as an example of an embodiment to be connected to an embedded air trap (baffle) 14 in the helmet facepiece. The air trap baffle is not illustrated but is described below.

Figure 2:
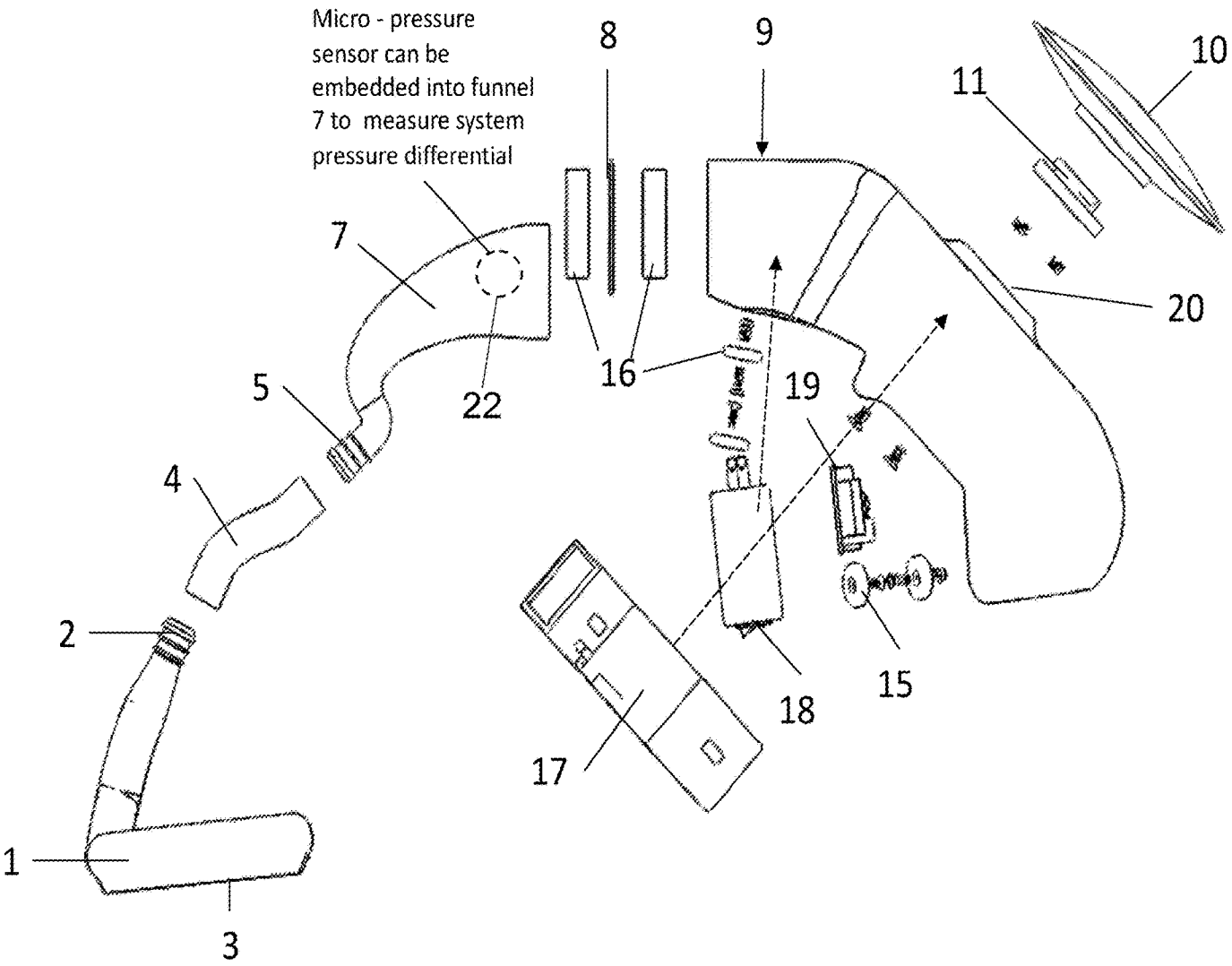
FIG. 2 is a schematic illustration of an example embodiment, providing an exploded left view of a duct system and detachable cowl system.

FIG. 2 is a schematic illustration of an example embodiment, providing an exploded left view of the duct system and detachable cowl system. In conjunction with a battery 18, universal bayonet connector 11, filter element 10, top spoiler funnel 7, internal air duct 4 and visor air curtain 1, the blower fan 17 provides a steady laminar flow of filtered air to the user. The cowl outlet 9 attaches to the top spoiler funnel 7 with the detachable cowl mounting system 16 (ring magnets or similar) with a gasket 8 sandwiched between the top spoiler 6 and cowl outlet 9 to provide an airtight seal. The cowl mounting system 16 attaches to the helmet shell with the embedded magnets 15. The microprocessor and control board interface 19 with manual control knob for fan duty cycle may be seated in the top portion of the cowl 9.

Figure 3:
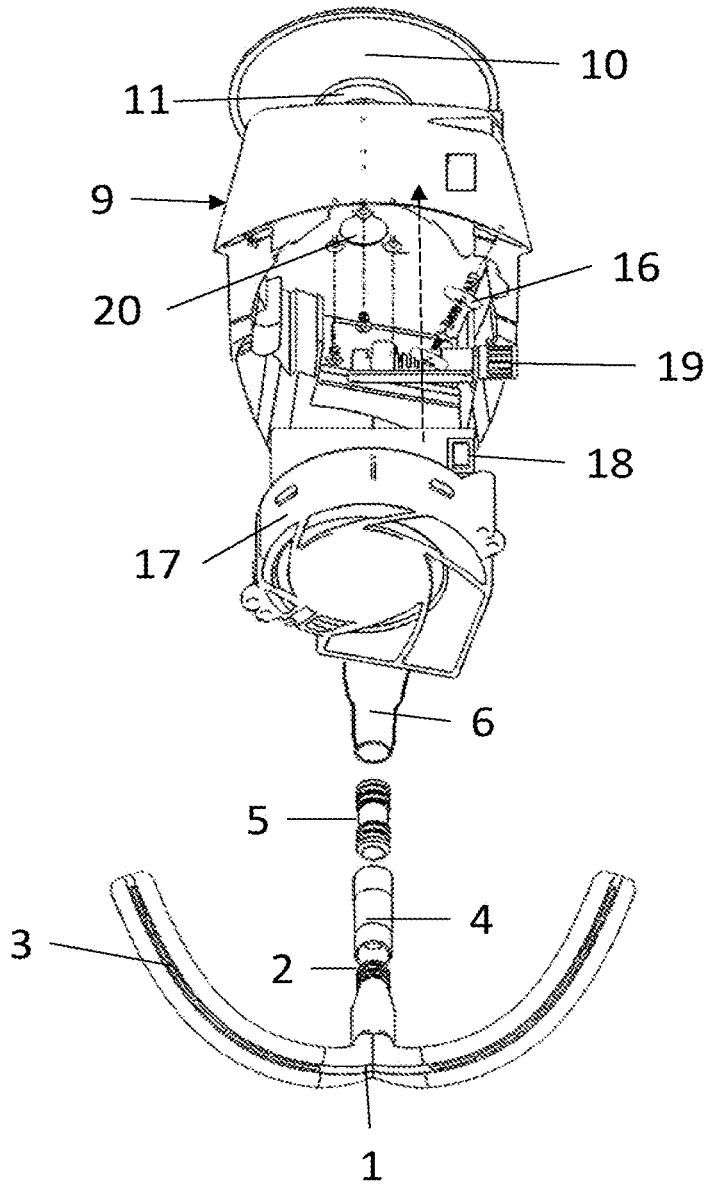
FIG. 3 is a schematic illustration of an example embodiment, providing a duct system and detachable cowl bottom view.

FIG. 3 is a schematic illustration of an example embodiment, providing a duct system and detachable cowl bottom view. The visor air curtain 1 is shown with the T-junction and knife edge 3 connected with coupling 2 to internal air duct 4 to top spoiler funnel coupling 5 to top spoiler funnel 7. The battery with system manual switch 18 can connect to the inside rear of the cowl 9 with the switch and accessible to the user. The microprocessor and control board interface 19 with manual control knob for fan duty cycle may be seated in the top portion of the cowl 9 with the control knob external and accessible to user. The blower fan 17 is seated in the cowl 9 flush with the internal blower fan inlet 20, attached and sealed with a modified gasket and universal bayonet connector 11 that connects to the filter element 10. The cowl mounting system 16 attaches to the helmet shell with the embedded magnets 15.

The present invention provides a system of head protection, e.g., a helmet, with integrated air filtration, or a system of head protection with filtered air without the need of an aiding facemask or other face covering to provide clean filtered air to the user. The present invention uses laminar flow in which air travels smoothly or in regular paths, in contrast to turbulent flow, in which air undergoes irregular fluctuations and mixing. In laminar flow, sometimes called streamline flow, the velocity, pressure, and other flow properties at each point remain substantially constant. Laminar airflow is typically used in what is known as a Clean Room for surgical theaters, patient room, nurseries, bacteriology work areas, or food preparation areas where filtered air moves along separate parallel flow planes in constant streams to the designated area to prevent bacterial contamination and to facilitate collection of hazardous chemical fumes in areas where they would pollute the work environment. In example embodiments of the present invention, laminar airflow is delivered through a visor air curtain 1, sometimes referred to as a 'knife edge', providing continual filtered airflow over the user's face where the user can breathe in the clean air without the obstruction of a facemask or covering. Excess air from the system flows out of the bottom of the facepiece through the exhaust holes in the neck dam 13, a flexible fabric (or material) slip that is attached to base of the helmet and surrounds the neck of the user creating a supplemental protective barrier against outside air contaminants. In aerosol tests performed in September 2020, an example embodiment of the present invention showed an average efficiency of 94% in controlling particulates in an air polluted test chamber, and greater than 95% efficiency when the system is used in conjunction with the neck dam.

An example embodiment comprises a detachable cowl 9 that encloses (or houses) and protects the system's electrical and filter components with a thin foam ethylene propylene diene terpolymer (EPDM) or similar material lined shell. The cowl 9 mounts to the rear exterior of the helmet shell. The cowl 9 can be made of a flexible durable plastic or similar material such as thermoplastic polyurethane (TPU). The components contained in the cowl can include a microprocessor control board interface 19 (FIGS. 2-3), centrifugal fan 17, battery 18, manual switch 18, universal filter bayonet connector 11 configured to attach a NIOSH-certified filter 10 externally to the cowl 9. The cowl 9 can adjoin to the helmet with a mount system that can meet impact attenuation standards in accordance with DOT testing procedures FMVSS no. 218. The cowl 9 can be easily removed from the helmet by hand for recharging and detach from the helmet at specified DOT impact velocity and loading conditions. The cowl mounting system 15-16 can comprise Neodymium magnets, as an example, or a similar attachment mechanism, embedded into the cowl base and the helmet shell allowing the cowl to connect firmly to the helmet top spoiler while also detaching from the helmet at specified DOT standards.

Duct System Components

A duct system suitable for the present invention comprises a funnel housed by the top spoiler, an internal clean air duct (or tube) and a visor air curtain 1. Other system components are described in the Air quality sensor components and detachable cowl sections. Details explaining duct system embodiments are described below.

Visor air curtain 1 with T-junction coupling 2: An 'air curtain' sometimes referred to as a 'knife edge' provides a steady uniform (laminar) sheet of airflow sometimes used in buildings as a barrier against outside air contaminants and insects. In the present invention, the upside-down teardrop shaped knife edge of the visor air curtain 1 creates continual filtered laminar airflow creating an air curtain between the visor (or face shield) and the user's face to allow the user to breathe clean filtered air while preventing polluted ambient air from entering the helmet. Laminar air flowing from the visor air curtain over the visor can be effective in preventing fogging of the visor/face shield (a common occurrence with motorcyclists and risk due to poor visibility), operating like a vehicle windshield defrost. The visor air curtain can be seated or embedded along the inside shell lining of the helmet just above forehead and visor (or face shield). The visor air curtain can comprise a strong flexible material made of TPU or similar strong and flexible material that can function without compromising the crash integrity of the helmet shell liner. Stents (a device or mold of a suitable material used to provide support for tubular structures that are inosculated) can be incorporated spaced, e.g., uniformly, inside the visor curtain knife edge plane 3 to prevent pinching (e.g. during assembly). The visor air curtain has a fitted T-junction coupling 2 positioned at the top center of the visor air curtain that connects to the internal air duct 4. As seen in FIG. 3, the visor air curtain T-junction can be configured so that the flow transition from internal air duct to two perpendicular air curtains remains uniform across the longitudinal direction of the air curtain, e.g., so that filtered air does not only flow out of the center T-junction portion of the visor air curtain knife edge 3, but rather disperses evenly across the entire knife edge plane.

Internal clean air duct (or tube) 4: The internal clean air duct 4 connects between the visor air curtain T-coupling and the top spoiler coupling 5. The internal clean air duct 4 can comprise vinyl or similar flexible tubing and can vary in size (diameter) based on the output of the blower fan, though laboratory tests have shown that a 0.5-inch tube is effective in some embodiments. The internal clean air duct/tube 4 can function without interfering with the crash integrity of the helmet shell liner.

Top-spoiler funnel 7 with coupling 5 for internal clean air duct 4: The helmet top spoiler 6 can comprise an aerodynamic plastic (polyurethane or similar material) spoiler fastened to the top center of the helmet shell by a strong permanent epoxy with a rigid cavity that can house top spoiler funnel 7. The funnel 7 at the top spoiler rear entry may have an inside diameter (ID) equal to the ID of the cowl 9 opening. In one embodiment of the present invention, the ID of the top spoiler funnel at the rear entry is 1.0 inch and reduces to an ID of 0.5 inch at the top spoiler funnel coupling 5 connection. The top spoiler funnel coupling 5 passes through a hole (with outer diameter (OD) allowing the coupling to fit) in the helmet shell at the top center of the helmet where it connects to the internal clean air duct 4.

A pressure sensor can be integrated into the top spoiler funnel (or duct system) to notify the user if there is a significant internal pressure drop that may be indictive of filter load and the need for filter replacement. Proper differential pressure levels can ensure the system is working as intended. As such, a micro pressure sensor can monitor pressure inside and outside of the duct system to confirm the differential remains within the acceptable range. The pressure drop level can be calibrated and communicated with the microprocessor control board interface and notify the user via Bluetooth to a smart device when the filter element is clogged and needs replacement.

Oxygen diffuser: In some embodiments of the present invention for high particulate applications, an oxygen diffuser can be integrated such that when the particulate readings are high, oxygen is released from a cartridge or similar device into the duct system and diffused over the user's face via the visor air curtain.

The mounting system 16 connection between the top spoiler 6 and cowl 9 can comprise Neodymium magnet(s), or similar strength magnets or attachment mechanisms, e.g. ring magnet(s) with the desired diameter and ID of the funnel opening.

The funnel 7 in the present invention can be optimized for various embodiments using methods called Adjoint Shape Optimization (first described in the academic paper by B. Pironneau & 0. Mohammadi in 1999: Mesh Adaption and Automatic Differentiation for Optimal Shape Design). These methods are public domain (opensource) and many variations have been made public since the original paper. These methods are often used for 3D printing duct cooling systems and has been shown to improve airflow efficiencies by as much as ten percent.

Neck dam (or barrier) 13 and Velcro adhesive 12: The neck dam or barrier 13 can be configured to prevent ambient air from entering under the facepiece of the helmet or head protection. The neck dam 13 can comprise a flexible slip that is attached to the base of the helmet and compatible with the helmet strap (or retention system). The neck dam 13 surrounds the neck of the user creating a supplemental protective barrier against outside air contaminants. The neck dam 13 can comprise a material such as Neoprene that is impermeable and can have flexibility to allow the user to easily slip over the head and maintain a seal around the user's neck. The head protection or helmet can have a Velcro 13 (or similar adhesive material) strip (hook side) around the base of the helmet that attaches to the neck dam (with a loop side) to provide a seal and be easily removable. Excess air from the system can flow out of the bottom of the facepiece through the neck dam exhaust holes. The neck dam can comprise a filtering material to further remove particulates that may enter under the helmet facepiece and allow excess air from the system to escape.

Air Quality Sensor Components

Air quality sensor 21, facepiece air trap (baffle) 14 and neck dam 13: The present invention can comprise a facepiece air trap (or baffle) 14 that can be integrated into the head protection (helmet) facepiece to 'trap' and slow down ambient air before entering the air quality sensor inlet. The air trap (baffle) can comprise a small funnel shaped inlet embedded in the facepiece that connects to a micro-spiral air tube system to slow down ambient air and capture moisture at the lower portion of the spirals before entering the air quality sensor device's air inlet such that the slowed ambient air can be read by the sensor cavity, e.g. laser scattering measuring cavity, before exiting the sensor and air trap. This air trap can permit higher resolution particle size binning and detection of particle composition for more accurate PM sensor readings. It can help with more accurate readings in high wind conditions, e.g. a motorcycle user traveling at higher speeds. It can also help prevent water condensation and damage to the sensor apparatus from moisture caused by inclement weather.

For air quality monitoring and control and activation of the system, a micro- or ultra-slim packaged PM sensor 21 can be embedded into the facepiece inlet and affixed to the internal air trap 14 described above to measure ambient air particle pollutants and trigger the system to switch on when the calibrated PM level, ideally PM2.5 or less, are encountered using the 'auto' setting. The system can also be switched on manually by the user.

There are several types of PM micro-sensor technology that can be suitable with the present invention for readings of PM 2.5 or less. One type of PM sensor that can be suitable for the present embodiment uses laser scattering to radiate suspended particles in the air, then collects scattering light to obtain a curve of scattering light change with time. The microprocessor calculates equivalent particle diameter and the number of particles with different diameter per unit volume. Particulate matter per 0.1 liter of air, can, for example, be categorized into 0.3 micrometer (μm), 0.5 μm, 5.0 μm and 10 μm size bins.

A dust sensor is another type of PM sensor can work with the present invention. The dust sensor gives an indication of the air quality by measuring the dust concentration. The PM level in the air is measured by counting the Low Pulse Occupancy time (LPO time) in a given time unit. LPO time is proportional to PM concentration. This type of dust sensor can provide reliable data for air purifier systems; it is responsive to PM of diameter 1 μm. This sensor uses a counting method to measure dust concentration instead of a weighing method.

Gas and oil particulate sensor: several types of gas particulate micro-sensor technology can be suitable with the present invention, including for sensing of volatile organic compounds (VOC) or nitrogen oxides (NOx) present in automobile exhaust. Chemical and biological contaminants: for industrial or military application, the present invention can be adapted with sensors to detect chemical and biological contaminants.

Detachable Cowl 9 (removable enclosure apparatus) for Impact Attenuation

An embodiment of the present invention includes an aerodynamic detachable cowl (or removable enclosure apparatus) 9 that houses and protects system components from inclement weather and attaches to the rear exterior of the helmet shell and affixes to the top spoiler. The components contained in the cowl include the microprocessor control board 19, centrifugal fan 17, battery and manual switch 18, universal filter bayonet connector 11 and the NIOSH-certified filter 10. The cowl 9 attaches to the back portion of the helmet shell and integrates with a mount system 16 designed to meet impact attenuation standards in accordance with DOT testing procedures FMVSS no. 218. The cowl 9 can be removed from the helmet by hand and can detach from the helmet at specified DOT impact velocity and loading conditions. In addition to being configured to meet DOT requirements, the cowl 9 is also configured to protect components, not compromise the structural integrity of the helmet shell, and increase pressure recovery on the rear of the helmet while helping reduce particulate going into the helmet, e.g. drawing ambient air from the rear of the helmet instead of the front, where the user may encounter higher particle load. The cowl 9 connects to the top spoiler funnel 7 with a mounting system described herein using an EPDM foam gasket for the seal.

Detachable Cowl System Components Include:

Microprocessor control board 19: A microprocessor control board 19 can calculate equivalent particle diameter and the number of particles with diameter size per unit volume and can calibrated to activate the system when the calibrated particle size (e.g., PM2.5, but can be set higher to PM10 for example to filter nuisance particles) and particulate count has been reached. The microprocessor control board can be programmed to adjust the blower fan duty cycles based on PM load. PM load corresponds to fan speed or duty cycle whereby a high PM load will increase fan speed. The microprocessor can be configured for Bluetooth capability and connect to the user's smart device for a digital output of PM and other air quality readings. In an example embodiment of the invention, the user will have access to their air quality data via a smart device providing valuable air quality data, notifications about the battery charge level and filter life, e.g., when the filter needs replacement. The user's air quality data can be bi-directional—uploaded to a cloud and aggregated and shared back with other users (with the user's permission). The users can receive alerts and have access to 'heat-maps' with an overlay of aggregated user data and data integrated from national and state agency air quality stations.

System power supply 18: The system can be powered by replaceable, rechargeable, or both, battery 18 that can connect to and power the microprocessor control board 19, particle sensor 21, system switch 18 and the centrifugal fan 17. The battery 18 can be embedded inside the cowl 9 with an adhesive foam (EPDM) gasket that provides insulation and protection. The battery can be a lithium, lithium polymer (LiPo), or battery of similar power efficiency and light weight and small size and able to power the system for five hours or more without recharge. The battery can be 12 volts to recharge on a vehicle (e.g., motorcycle power outlet with port for USB) or similar battery compatible with the vehicle electrical output. The cowl 9 with an embedded battery charging port can be easily removed and connected and charged on a standard electrical outlet. The embedded cowl charging port can be a female Universal Serial Bus (USB) or female barrel connector or similar charging connection. Other power supply configurations can also be used, e.g., solar powered—in an example embodiment the present invention can be powered through solar cells or panels mounted on or embedded in the head protective shell; wind powered—in another embodiment the present invention can be powered through wind generators or micro-turbines mounted on the head protective shell. This embodiment can be a feasible recharging solution for motorcycle users when they are riding at higher speeds.

System switch (On/Off/Auto) 18: The system detachable cowl 9 can be fitted with a switch with settings for 'On' where the system stays on until turned off by the user; 'Off' where the system remains off and does not come on when the PM sensor 21 activates the system to run at the desired duty cycle, or 'Automatic (Auto)' where the system remains off and is activated when harmful particulates at the desired duty cycle are encountered. The switch can be mounted in an easily accessible location for the user to reach while wearing the system. A system can comprise a control knob to adjust the fan speed manually when the switch is in the 'On' position. The system can also be turned on via a Bluetooth, voice activation or similar application from a smart device or onboard vehicle system, such as a smart dashboard. In the embodiment illustrated in FIGS. 2-3, a manual switch is integrated with the battery element 18. In other embodiments the switch and battery element can be separate.

Centrifugal (or Blower) fan 17: A centrifugal fan-often referred to as a blower fan—is a mechanical device for moving air in a direction at an angle to incoming fluid. The kinetic energy of the impellers increases the volume of the airstream, which in turn moves against the resistance caused by air ducts, tubes, filters, or other components in the present invention. A blower fan (or fans) can be suitable in the present invention due to being constant-displacement or constant-volume devices, e.g., at a constant fan speed, a centrifugal fan moves a relatively constant volume of air (rather than a constant mass), even if the system pressure varies.

In the present invention, a centrifugal fan 17 can be seated inside the cowl 9 along with the battery 18 and other electrical system components. The fan can be protected by an adhesive EPDM or similar foam that can also seal and prevent air from leaking from fan connection points. The fan can be powered by a rechargeable battery (various power supply embodiments described above). In conjunction with a battery 18, universal bayonet connector 11, filter 10, top spoiler funnel 7, internal air duct 4 and visor air curtain 1, the blower fan 17 provides a steady laminar flow of filtered air to the user. Various types and sizes of blower fans exist and can be optimized with the present invention based on battery size in voltage (volts) and amperage (amps) and power output in revolutions per minute (RPM) and air flow rate in cubic feet per minute (CFM), slim size and durability, e.g., constructed of a strong and lightweight material. In laboratory tests of one embodiment of the present invention, a blower fan of 12 volts, 3.4 amps, 56.8 CFM max and 6850 RPM max was most effective for system operation. In one embodiment, to maximize cowl space and efficiency, all (or a portion) of a typical centrifugal fan housing can be removed and some or all internal components (impeller wheel, drive, motor, etc.) can be integrated directly into the cowl apparatus.

Blower fan inlet seal 20, filter element 10, and universal modified bayonet connector with gasket 11:

Blower fan inlet seal 20: The blower fan 17 air inlet can be covered and sealed with a universal modified bayonet connector 11. A bayonet connector is a circular connector with gasket commonly used on respirators for NIOSH P100 rated filters. Each brand has a slightly different bayonet connector. The present invention can comprise a bayonet connector configured to mount with a specific brand, replaceable connectors each configured to mount with a specific brand, or a universal modified bayonet connector 11 that allows the user to affix a range of NIOSH P100 or similar certified filter elements to the system.

Filter element 10: The filter element 10 connects to the universal modified bayonet connector with gasket 11. The filter element suitable for the present invention can be an off-the-shelf NIOSH-certified disposable filter, ideally with a minimum P100 rating. A P100 rating means that the filter has been tested to be impermeable against oil and tested to filter 99.97% of all particles 0.3 microns in diameter or larger. A P100 rated filter is suitable for the present invention because it can filter automobile exhaust, wildfire smoke and other harmful particulates to motorcycle users. For other applications that may encounter harmful gases such as VOCs the system can be fitted with an organic vapor cartridge.

Detachable cowl mount system 15-16: the cowl can have embedded Neodymium magnets embedded in the base of the cowl 9 and embedded in the helmet shell 15 with the desired pounds of strength to meet the DOT impact attenuation requirements. The front facing portion of the cowl with the blower fan outlet may comprise of Neodymium ring magnets with a gasket to create an airtight seal between the cowl and top spoiler funnel.

Embodiments of the Present Invention can Provide Benefits in Various Applications, Including:

Head protection for motorized or non-motorized vehicles. For motorcyclists (both recreational and commuter), the present invention can be useful for motorcyclists who are particularly vulnerable to poor air quality, including automobile exhaust, particulate matter from road and highway dust, smog in major urban areas or smoke from wildfire areas. For automobile drivers, e.g., rally racers who often use large pumps to force air through their helmet. For bicyclists, embodiments of the invention can be useful for filtering harmful auto exhaust and dust particulates in recreational or commuter settings. Embodiments can also provide anti-fogging of the visor and cooling to the user.

Wildland-urban firefighting. In embodiments with a fireproof protective shell material (such as Nomex) the system can be a practical solution for firefighters in wildland or wildland-urban interface fire situations (rather than structural firefighting that requires oxygen supply) where head protection is required and firefighters can encounter moderate particulate contamination. Embodiments with an integrated oxygen cartridge diffuser embodiment can be particularly useful for these applications.

Military/Warfighting. Urban warfare—embodiments can be used for urban warfighting where blast debris and biowarfare (biological or chemical contaminants) might be encountered by warfighters. Aircraft carrier flight deck crew—these workers encounter considerable amounts of dangerous exposure from warplane fuel and exhaust and embodiments can be used to protect flight deck crew. General warfighting—air to ground combat situations where soldiers enter target sites post impact and debris and dust can be debilitating or other combat situations where explosives cause heavy particulate contamination. Biological or chemical warfare situations. Embodiments with an integrated oxygen cartridge diffuser can be particularly useful for these applications.

First Responder/Medical. Contagious diseases—Embodiments can be useful for first responders during contagions or those who work in an environment with prevalent disease spread through aerosol droplets and respiration. First responders face unique risks of being the first people to aid those with unknown contagions. Earthquakes and other natural disasters-similar to wildland firefighting scenario, embodiments can protect first responders in earthquake damaged structures or similar scenarios where both protection for the head and from debris and dust can be debilitating.

Industrial. Many industrial processes result in dangerous gases or debris that can impact respiratory health. Embodiments can aid in protecting industrial workers such as welders and mining and construction workers.

Although the present invention has been described in some detail by way of illustration and example for purposes of clarity of understanding, one of skill in the art will appreciate that certain changes and modifications may be practiced within the scope of the appended claims. In addition, each reference provided herein is incorporated by reference in its entirety to the same extent as if each reference was individually incorporated by reference.

What is claimed is:

1. An apparatus comprising:
a connector configured to accept an air filter;
an airflow system configured to mount to a helmet wherein the airflow system is further configured to draw air from the connector and produce air flow through a visor air curtain;
a cowl configured to be detachably mounted with an exterior of the helmet;
a centrifugal fan mounted within the cowl;
a battery; and
a microprocessor control board wherein the microprocessor control board controls operation of the centrifugal fan and accepts power from the battery.

2. The apparatus of claim 1, wherein the visor air curtain is configured to produce a substantially laminar airflow.

3. The apparatus of claim 1, further comprising:
a neck dam configured to mount to a base of the helmet.

4. The apparatus of claim 3, wherein air from the visor air curtain passes through the neck dam.

5. The apparatus of claim 1, wherein the cowl mounts with the helmet using one or more magnets.

6. The apparatus of claim 1, wherein the cowl detaches from the helmet at a predetermined impact velocity.

7. The apparatus of claim 1, wherein the cowl detaches from the helmet at a predetermined loading condition.

8. The apparatus of claim 1, wherein the visor air curtain comprises a T-junction that distributes air across a knife edge plane formed by the visor air curtain.

9. The apparatus of claim 8, further comprising:
stents in the knife edge plane.

10. The apparatus of claim 1 further comprising:
a duct extending from the connector to the visor air curtain.

11. The apparatus of claim 1, further comprising:
a pressure sensor configured to provide a signal representative of pressure differential between the inside and outside of the airflow system.

12. The apparatus of claim 1, further comprising:
an air trap baffle formed in the helmet.

13. The apparatus of claim 1, further comprising:
an air quality sensor mounted with the apparatus and providing a signal representative of quality of air supplied through the apparatus.

14. The apparatus of claim 13, wherein the microprocessor control board controls the airflow system responsive to the air quality sensor.

15. The apparatus of claim 1, wherein the microprocessor control board is configured to control the airflow system.

16. The apparatus of claim 15, wherein the microprocessor control board comprises a switch that controls the airflow system in response to the switch.

17. An air quality system comprising:

a cowl configured to be detachably mounted with an exterior of a helmet;

an air filter operably connected to the cowl;

an airflow system configured to mount to a helmet wherein the airflow system is further configured to draw air from the air filter and produce air flow through a visor air curtain;

a centrifugal fan mounted within the cowl; and a microprocessor control board wherein the microprocessor control board controls operation of the centrifugal fan.

18. The air quality system of claim 17, further comprising:

a neck dam configured to mount to a base of the helmet.

19. The air quality system of claim 17, wherein the visor air curtain comprises:

a T-junction that distributes air across a knife edge plane formed by the visor air curtain.

20. An apparatus comprising:

a cowl configured to be detachably mounted with an exterior of a helmet;

a connector associated with the cowl and configured to accept an air filter;

an air visor curtain configured inside the helmet;

an internal air duct configured to provide air from the cowl to the air visor curtain;

a centrifugal fan mounted within the cowl; and a microprocessor control board wherein the microprocessor control board controls operation of the centrifugal fan.

* * * * *